United States Patent [19]

Lyons et al.

[11] Patent Number: 4,545,337

[45] Date of Patent: Oct. 8, 1985

[54] ROTARY VALVE ENGINE

[76] Inventors: George A. Lyons, 26053 Elsinore, Redford, Mich. 48239; David R. Kosa, 10575 Swan Creek, Carleton, Mich. 48117

[21] Appl. No.: 611,627

[22] Filed: May 18, 1984

Related U.S. Application Data

[63] Continuation of Ser. No. 330,563, Dec. 14, 1981, Pat. No. 4,473,041.

[51] Int. Cl.[4] ..... F01L 7/16

[52] U.S. Cl. ..... 123/80 BA; 123/190 A; 123/190 DL

[58] Field of Search ..... 123/80 R, 80 BA, 190 R, 123/190 A, 190 B, 190 BB, 190 BD, 190 E, 190 DL

[56] References Cited

U.S. PATENT DOCUMENTS

| | | | |
|---|---|---|---|
| 3,993,036 | 11/1976 | Tischler | 123/80 BA |
| 4,007,725 | 2/1977 | Weaver | 123/80 BA |
| 4,019,487 | 4/1977 | Guenther | 123/190 A |
| 4,077,382 | 3/1978 | Gentile | 123/190 A |
| 4,333,427 | 6/1982 | Burillo et al. | 123/190 E |

*Primary Examiner*—Parshotam S. Lall
*Assistant Examiner*—W. R. Wolfe
*Attorney, Agent, or Firm*—Harness, Dickey & Pierce

[57] ABSTRACT

Rotary inlet and exhaust valves disposed within the cylinder head located at one end of at least one cylinder of a vehicle engine, the cylinder having inlet and exhaust ports, and the valves having a mechanism to feed an inlet charge to and exhaust from the respective cylinder ports along the axis of rotation of the valves. Mechanisms for reducing eddy losses, insulating the exhaust valve, and lubricating the valves by either a wet or dry lubricator, or both, is also included, as well as single and multi-cylinder variations of the valves for various vehicle engines.

8 Claims, 13 Drawing Figures

FIG. 3.
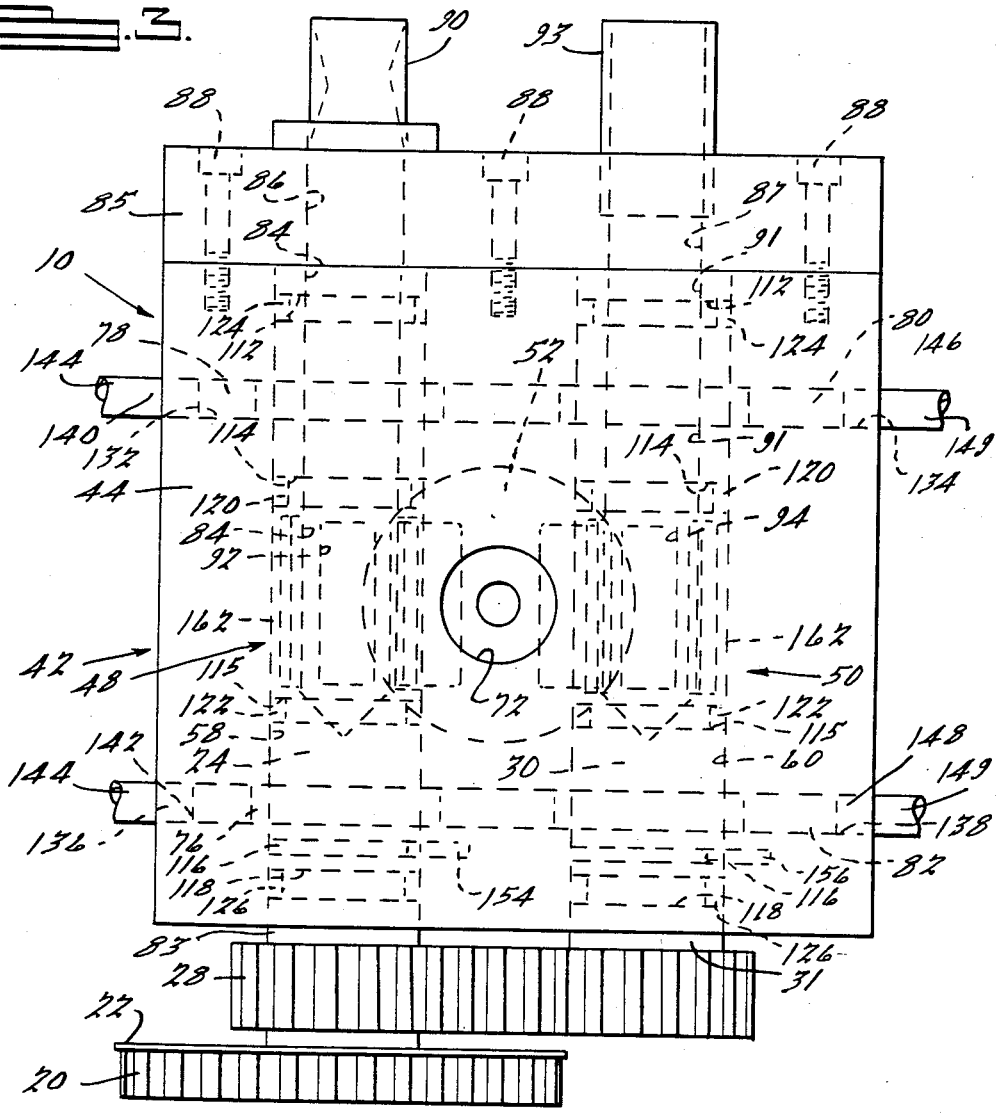
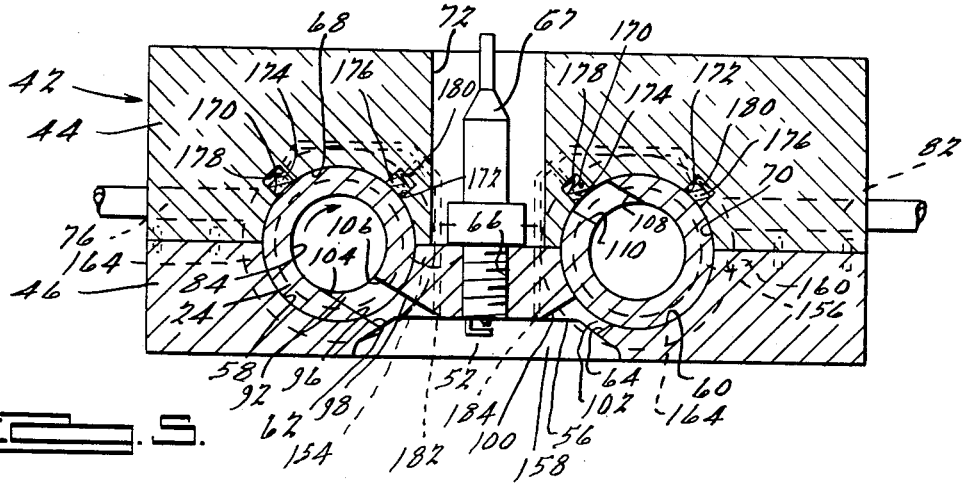
FIG. 5.

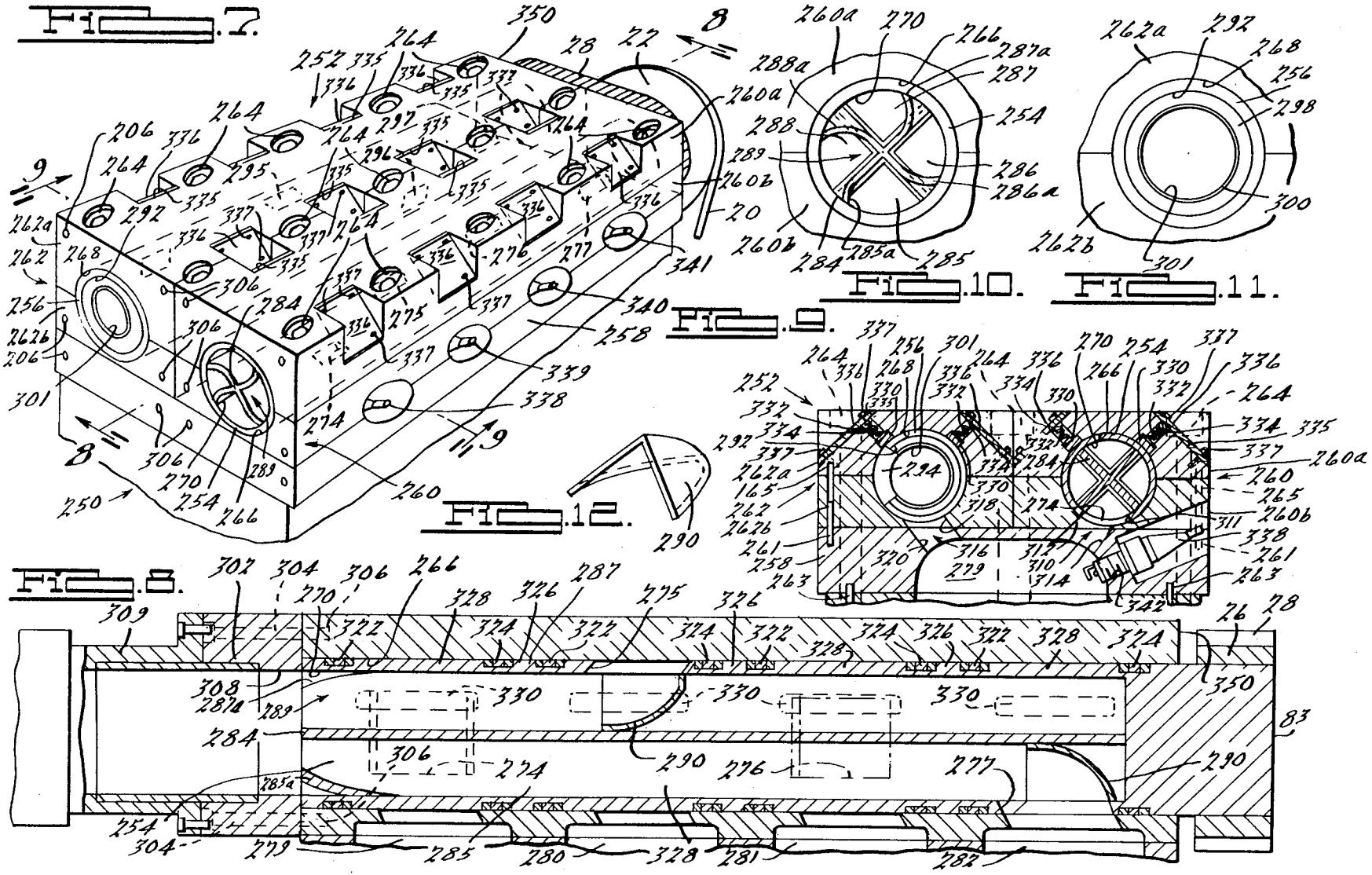

ROTARY VALVE ENGINE

This is a continuation of application Ser. No. 330,563, filed Dec. 14, 1981, now U.S. Pat. No. 4,473,041, issued Sept. 25, 1984.

BACKGROUND AND SUMMARY OF THE INVENTION

The present invention relates generally to vehicle engines and particularly to four-stroke vehicle engines using rotary valves to input a charge to a cylinder of the engine and exhaust the residual from the cylinder of the engine.

The use of rotary valves in the present invention eliminates a number of heavy castings, such as the inlet and exhaust manifolds, and other mechanical parts over such conventional engines as a standard poppet valve four-stroke engine as is conventionally used in motor vehicles today. The present rotary valve constructed disclosed and claimed herein has the capacity to be of lesser weight and capable of lower cost than a conventional four-stroke engine, and equally, if not more, mass producible, along with fewer mechanical problems from the standpoint that fewer mechanical parts are used.

Although several types of rotary valve constructions have been proposed in the past, none have become commercially feasible. One problem is that the majority of the rotary valve constructions proposed in the past needed substantial modification to the engine. Thus, a further object of the present invention is that a tubular rotary valve construction is provided that can be mounted on a conventional four-stroke engine block as a head replacement with little or no modification to the block. The rotary valves are integrated into the engine head to be readily applicable to in-line engine blocks in particular, although the present invention can also be used on "V" or radial engines. The maximum advantages in low weight and low costs, however, occur with in-line engines.

Another problem with prior art rotary valve constructions is that they are not readily machineable and mass producible. Thus, the present invention has a further object of being readily machineable and mass producible in order to be placed in a conventional assembly line for production of automotive vehicles or the like.

It is a further object of the present invention to minimize dead space or unused space within the combustion chamber and provide a rotary valve construction where the charge enters and the exhaust exits the cylinder at the top of the cylinder above the piston. Minimizing dead space uses the charge more efficiently and permits more charge to enter and be combusted in the working chamber of the engine for a given displacement since less residual will remain in the working chamber with the present construction.

In accordance with the object of the present invention to provide a lighter weight engine than a conventional engine, the present invention has still another object of providing a rotary valve construction with minimal external manifolding in place of the heavy castings and camshafts that exist in most conventional four-stroke engines today. Also, this minimal manifolding is to be provided with the capability of permitting the carburetor and/or an exhaust extension to be situated anywhere around the vehicle engine, including above the transmission in a transversely mounted engine or above the engine as is conventionally done on a longitudinally mounted engine.

Also in accordance with the object of providing an engine of lighter weight is the object of the present invention to be capable of providing an even smaller head and a smaller engine than a conventional engine with the same power and displacement. In the present invention, very little spacing is necessary between the cylinder bores, very little spacing is necessary between the valve bores, and the valve bores can be spaced from one another along a plane intersecting the centerline of the cylinder at an acute angle to compact the head even further.

A still further object of the present invention is to minimize any eddy losses and take advantage of vortex or swirl effects in manifolding the charge and the exhaust through the valves. A modified embodiment of the present invention theoretically should reduce any eddy losses by approximately 30% at the inlet and over 60% at the exhaust over the non-modified version of the present invention, while also taking advantage of the vortex or swirl effects.

With prior art rotary valve constructions, and all conventional poppet valve constructions, lubrication is generally a major consideration. The present invention, however, is readily amenable to be lubricated via conventional oil lubrication systems. Also disclosed herein is an improved wiper or wick type lubrication system for the valve of the present invention. A further option is a spring loaded wiper system for lubricating the valve using a lead graphite wiper or other solid dry lubricant.

Another object of the present invention is to provide all of the above objects in a manner also compatible to racing engines for vehicle racing where a large amount of change is desired to be fed to the inlet and exhausted in a much more rapid fashion than in a conventional vehicle engine.

The present invention can be implemented either for a single cylinder engine or a multi-cylinder engine. Bearings having close tolerances may be utilized since the present invention is highly amenable to accurate machining by having the parallel valve bores machined simultaneously side by side. Thus, the present invention has the advantage of a close tolerance bearing, wherein only one position key need be used for even a multi-cylinder engine.

Another further object of the present invention in the multi-cylinder engine embodiment thereof is even distribution of the fuel mixture. In the present invention, baffles may be utilized within the interior manifold of the inlet rotary valve to improve distribution of the fuel mixture and break up laminar flow to more properly mix the fuel and air mixture, or at least keep the fuel and air mixture from separating. The baffles would vary in design according to the engine application, but may include a compartmentalized baffle. Likewise, on the exhaust side, a combination exhaust valve and manifold exists as one of the advantages of the present invention.

The present invention also has the further object of being capable of use with a variety of fuels. This object also includes usage with engines having fuel injection systems distributing fuel directly to each cylinder, wherein the engine valve system of the present invention would provide a desired amount of inlet air and exhaust the residual mixture. Alternatively, the present invention has the object of being used with propane, hydrogen fuels, or any other fuels.

A still further object of the present invention is a greater efficiency than conventional poppet valve engines. The present invention does not require the horsepower usage needed in driving the cam shaft end of a poppet valve engine against the spring tensions of the poppet valves. Even more horsepower is used with higher performance of the engine. Also, the present invention on the exhaust side is believed to eliminate the hot spots on the exhaust poppet valves, which allows the present invention to run more totally advanced. Furthermore, on the inlet side, the inlet is almost instantly heated, unlike the cold initial inlet on a conventional engine or any other engine with external manifolding, to provide very good vaporization sooner than other externally manifolded engines. Low idle characteristics are also evident in the present invention to improve fuel economy in city driving.

Other objects and advantages of the instant invention will be apparent in the following specification, claims and drawings.

BRIEF DESCRIPTION OF THE DRAWINGS

FIG. 3 is a top elevational view of the head of the engine of FIG. 1;

FIG. 5 is a vertical sectional view along the lines 4—4 of FIG. 4, but with the cylinder head assembled and the valve ports slightly rotated to align the inlet valve port with the inlet port of the base plate of the cylinder head;

FIG. 7 is an elevated perspective view of a multi-cylinder embodiment of the present invention;

FIG. 8 is a vertical sectional view along the lines 8—8 of FIG. 7;

FIG. 9 is a transverse vertical sectional view along the lines 9—9 of FIG. 7;

FIG. 10 is a vertical sectional view of the inlet valve of FIG. 8;

FIG. 11 is a vertical sectional view of the outlet valve of FIG. 7;

FIG. 12 is an elevated perspective view of an unassembled pitched baffle of the inlet valve baffle of FIG. 7.

DESCRIPTION OF THE PREFERRED EMBODIMENTS

Figure 2:
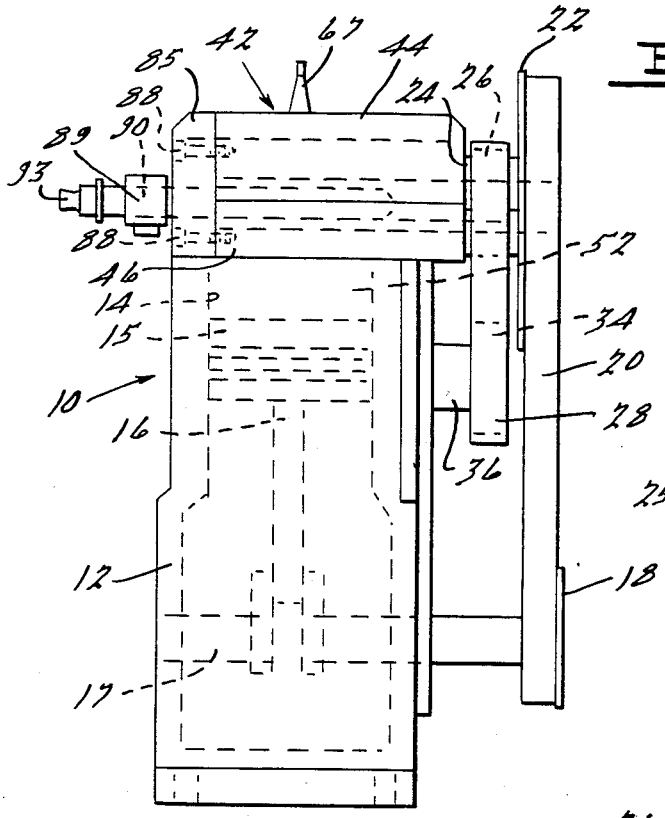
FIG. 2 is a side elevational view illustrating an engine of the present invention.

Referring to FIGS. 1 through 6, a single cylinder embodiment of an engine 10 within the scope of the present invention is illustrated. The engine comprises an engine block 12 within which a cylinder 14 is disposed along with a piston 15 which is moveable in both directions along the center line of the cylinder 14. The piston 15 moves via a connecting rod 16 to a crankshaft 17 having a drive pulley 18 disposed at the external end of the shaft 17. The crankshaft drive pulley 18 has teeth therein which engage the notches of a drive belt 20. The drive belt engages an engine drive wheel 22 disposed on a shaft 24 substantially vertically above the drive pulley 18. Concentrically disposed on the same shaft 24 is another pulley 26 having teeth thereon engageable with a belt 28. The shaft 24 is part of the inlet valving means of the engine 10, which will be described below. A shaft 30 disposed parallel to shaft 24 is part of the exhaust valving means which will also be described below. A pulley 32 having teeth engaging belt 28 is mounted on shaft 30. The belt 28 further extends around an idler pulley 34, mounted on a stub shaft 36 along having teeth engaging the belt 28. An adjustable tensioning pulley 38 is eccentrically mounted to the engine block by bolt 40. The eccentric mounting permits the wheel 38 to be moved into and out of the belt 28 to selectively tension the belt 28. Tightening of the bolt 40 locks the wheel 38 into a selected tensioning position.

Figure 4:
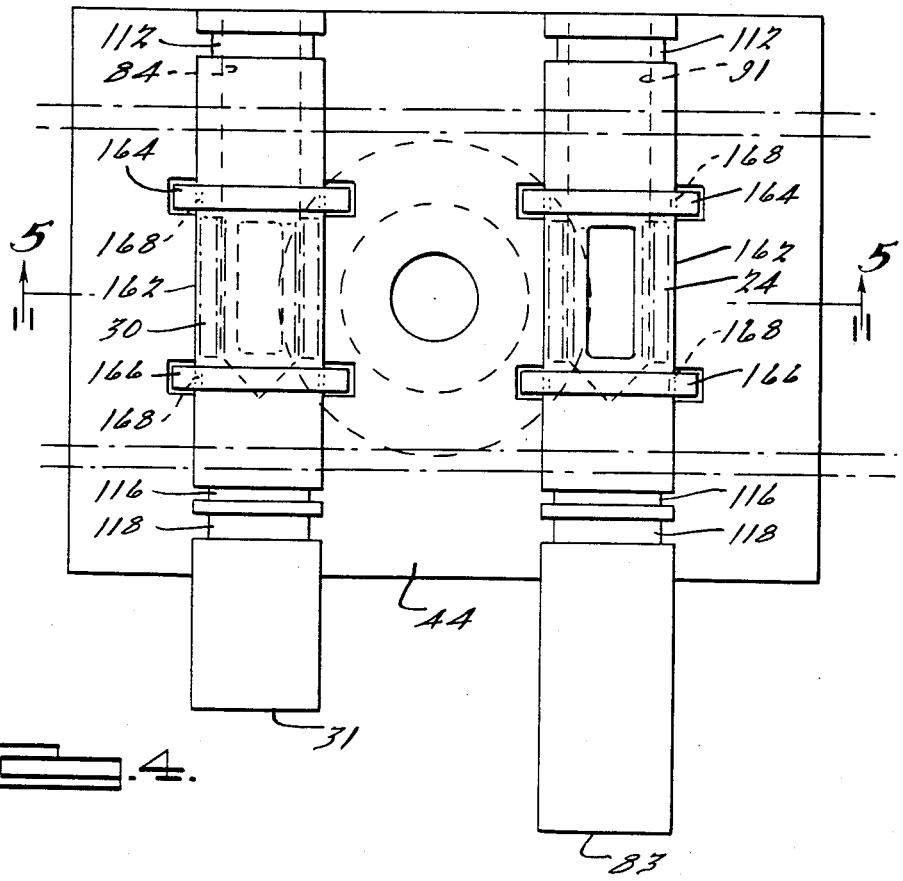
FIG. 4 is a bottom elevational view of the disassembled valves and upper cylinder head of an alternative embodiment of a cylinder head of an engine of the present invention.

The cylinder head 42 is conventionally mounted to the engine block 12 by a plurality of bolts threadably engaged into the engine block 12. Referring to FIGS. 3 and 4, the cylinder head 42 comprises an upper portion 44 and a lower portion 46 within which the inlet valving means 48 and the exhaust valving means 50 are operably disposed. The lower portion 46 of the cylinder head 44 forms the top portion of a working or combustion chamber 52 of cylinder 14. The working chamber 52 is formed by the walls of the cylinder 14, the top of the piston 15 and a recessed portion 56 of the lower cylinder head 46. Recesses 58 and 60 are milled in parallel along the length of the lower cylinder head 46. Inlet port 62 and outlet port 64 are bored through the lower cylinder head 46 to extend from recess 58 into recess 56 of the working chamber and from recess 60 into recess 56 of the working chamber, respectively. Inlet port 62 and outlet port 64 can be angled in two directions for a high degree of efficiency as will be described later. Threaded bore 66 is also included in the lower cylinder head 46 for location of a spark plug 67.

The upper cylinder head 44 (FIG. 3) comprises two complementary recesses 68 and 70 which form the bores when the upper 44 and lower 46 cylinder heads are operably disposed upon the engine 10 and within which bores the inlet valving means 48 and the outlet valving means 50 are situated. Spark plug access bore 72 is disposed through the upper cylinder head 44. Upper cylinder head 44 also includes oil lubrication passages 76, 78, 80 and 82 bored or milled in the upper cylinder head 44 for oil lubrication to the inlet valving means 48 and outlet valving means 50 as will be described later. Referring to FIG. 3, the inlet valving means 48 comprises a tubular shaft rotatable in the bore formed by recesses 58 and 68 in the lower and upper cylinder head portions 44 and 46, respectively. Tubular shaft 24 is driven by pulley 26 which is mated to one end 83 of the shaft 24. An interior bore 84 of the shaft 24 provides a means to manifold the inlet charge. As shown in FIGS. 2 and 3, a mounting block 85, having an inlet bore 86 and exhaust bore 87 is attached to both the upper 44 and the lower 46 cylinder heads by a plurality of bolts 88. A carburetor 89 is attached to the mounting block 85 and the inlet bore 86, axially aligned with the shaft 24 opposite the pulley end 83, via a coupling 90 to feed the inlet charge into the interior 84 of the shaft 24. The carburetor 89 is operably connected to inlet air and inlet fuel as is conventionally known in the art to provide an inlet charge of a desired fuel/air mixture.

Parallel to the inlet valving means shaft 24 is disposed the outlet valving means shaft 30 which also has an internal bore 91 which acts as the manifold for the exhaust from the combustion chamber and is connected at one end to the muffler, header, tail pipe extension, or whatever means is used for exhausting the residual from the working chamber out of the engine and out of the engine compartment. Pulley 32 is mounted at one end 31 of the shaft, drivingly connected to the inlet valving means shaft 24 by drive belt 28 to rotate the shaft in the same direction as the inlet shaft. Exhaust bore 87 of mounting block 85 is aligned axially with the outlet shaft 30 to manifold exhaust through the bore 87. Any further means for exhausting is secured to the mounting block 85 at the bore 87, such as a muffler or exhaust system 93 (FIG. 2).

Both the inlet shaft 24 and the outlet shaft 30 include ports 92 and 94, respectively, which align themselves with inlet port 62 and outlet port 64, respectively, of the lower cylinder head portion 46, and can be similarly angled in two directions.

One of the advantages of the present system is that if a conventional engine block is used, the timing utilized in that conventional engine can be readily duplicated by the rotary valve of the present invention. Also, no timing adjustment need be performed on the vehicle once the engine has been manufactured, as the timing will be set by the size of the ports, the gear teeth, and the belt used. Service of the engine thus will be greatly simplified.

As part of the oil lubrication means, the inlet shaft 24 and outlet shaft 30 each have a series of axially spaced grooves 112, 114, 115, 116 and 118 machined around the periphery thereof. Rings 120 and 122 are disposed in grooves 114 and 115 of the input and output shafts, respectively, to seal off the area of the shafts 24 and 30 where the ports 92 and 94, respectively, are disposed from the remainder of the respective shafts 24 and 30. Additional rings 124 and 126 are inserted in grooves 112 and 118 of the respective shafts 24 and 30. Oil galleys or passageways 76, 78, 80 and 82 (FIG. 3) are machined across the bottom surface 130 of upper cylinder head 44. When assembled, passageways 78 and 80 are disposed between rings 120 and 124, and passageways 76 and 82 are disposed between rings 122 and 126. Passageways 78 and 80 extend between threaded bores 132 and 134. Passageways 76 and 82 extend between threaded bores 136 and 138. Fittings 140 and 142, communicating with the output of an oil pump via conduit 144, are threadably disposed in threaded bores 132 and 136, respectively. Fittings 146 and 148, communicating with the input of the oil pump for the engine 10 via conduit 149, are threadably disposed in threaded bores 134 and 138, respectively.

Grooves 116 disposed along the periphery of shafts 24 and 30, respectively, between rings 120 and 124 act as valve retainer keyways for locking keys 154 and 156 disposed in seats 158 and 160 formed in lower head portion 46 (FIG. 5), respectively, to prevent axial movements of shafts 24 and 30, respectively. Lubrication is supplied to the grooves 116 by the oil lubrication means described above.

In the presently described embodiment, lubrication at the ports has not proven necessary in the single cylinder construction. Lubrication means at the ports 92 and 94, however, may be readily implemented in a variety of ways. FIGS. 4 and 5 illustrate a lubrication mechanism for the port area 162 of the shafts 24 and 30 with regard to an alternative construction of the shafts 24 and 30. The shafts 24 and 30 each include a pair of port sidewalls 164 and 166, replacing grooves 114 and 115, having a labyrinth network 168 running axially through the sidewalls 164 and 166 along the periphery of the port area 162 of each respective shaft 24 and 30. The sidewalls 164, 166 may be integral with the shafts 24, 30 or may be in the form of sleeves pressed onto each shaft 24 or 30. Pockets 170 and 172 are formed in the bores 68 and 70 of the upper cylinder head 44 (FIG. 5) wherein carbon wipers 174 and 176 each biased against the shaft 24 or 30 by a pair of springs 178, 180 are disposed. The pockets 170, 172 are disposed so that at the time of combustion, the port 92 or 94 has one circumferentially spaced carbon wiper 174 or 176 disposed on each side of the port 92 or 94. Each carbon wiper 174 or 176 fits in the pocket with the same configuration as the pocket, and allowing for a sliding tolerance, and rides on the valving means shaft 24 or 30 within the upper cylinder head 44. Small drilled orifices 182 and 184 may also be included in the upper cylinder head 44 to communicate the back of the pockets 170 and 172, respectively, with the working chamber 52 of the engine 10. Pressure from the working chamber 52 is fed through the orifices 182, 184 to supply pressure to the back of the wipers 174, 176 to provide further bias toward the valve during combustion, detonation, or whatever work stage is performed in the working chamber 52. Keys 154 and 156 and seats 158 and 160 are optional with this above described alternative embodiment.

It is also contemplated that the valving means and cylinder head disclosed herein may be cooled by air. Bearing areas may be lined with a solid contact lubricant (such as graphite) or replacement graphite inserts may be used on the bearing for lubrication. In the present invention, for some purposes, such as with steel valving means shafts and aluminum heads, engines may be maintained without bearing inserts and without port lubrication.

As stated above, and illustrated in FIG. 5, the inlet port 62 and exhaust port 64 in the lower cylinder head 46, the inlet port 92 of the inlet valving means 48, and the exhaust port 94 of the outlet valving means 50 can all be angled to improve the efficiency of the engine. As illustrated in FIG. 5, the lower cylinder head ports 62 and 64 have substantially parallel sides 96 and 98 and 100 and 102, respectively (in cross-section) each forming an angle of approximately 60 degrees with the centerline of the cylinder 14 (although that relationship may vary). The inlet port 92 has a leading edge side 104 which, when aligned during its rotation with side 96 of cylinder head port 62, similarly forms the same angle with the centerline of the cylinder 14, which in the illustrated embodiment is approximately 60 degrees. The inlet valving means port 92 has a trailing edge side 106, the tangent of which side 106 intersects the axis of rotation of the inlet valving means 48.

The outlet valving means port 94 has a leading edge side 108 the tangent of which side 108 intersects the axis of rotation of the outlet valving means 50. The port 94 has a trailing edge side 110, which when aligned during its rotation with side 102 of cylinder head port 64, similarly forms the same angle with the centerline of the cylinder 14, which in the illustrated embodiment is again approximately 60 degrees.

Figure 6:
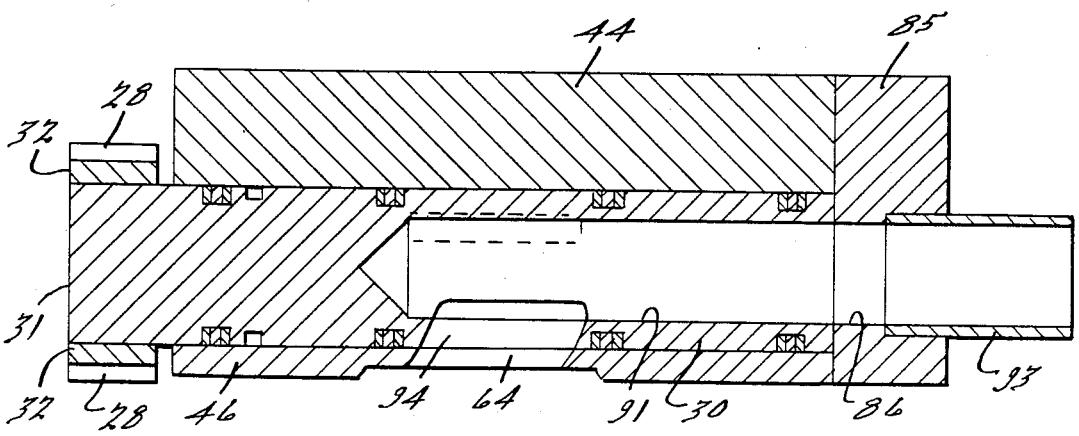
FIG. 6 is a vertical sectional view of a modified embodiment of one of the valves of FIG. 1.

Referring to FIG. 6, the ports 62 and 64 and/or 92 and 94 may also be machined to form an angle with the axis of rotation of the respective valving means 48 or 50. The direction of the angle depends upon the air flow direction, i.e. inlet or exhaust, in order to minimize eddy losses for peak engine efficiency. Theoretically, the eddy losses should decrease approximately 30 percent at the inlet ports 92 and 62 and decrease approximately 60 percent at the exhaust ports 94 and 64 if the ports can be angled at a 45 degree angle rather than a 90 degree angle. This angulation can be readially machined with a change of direction of the boring or milling tool, an operation existing machine tools are capable of performing in an assembly line setting.

Although in the constructions illustrated herein have both the input and exhaust rotors communicating the ports with the carburetion (or inlet air) and exhaust systems, respectively, at the axially opposite end of the shafts 24 and 30 from the driver ends 83 and 31 of the shafts, it should also be noted that with an outrigger mechanism, the ports may communicate with both the carburetion (or inlet air) and exhaust system through the driven ends 83 or 31 of the shafts 24 and 30 if so desired. As a further alternative, the drive pulleys 26 and 32 may be disposed at opposite ends of the cylinder head 42. Furthermore the carburetion (or inlet air) system may communicate with the driven end of the input shaft 24 and the exhaust system may communicate as is illustrated in the drawings with the opposite end of the exhaust valving means shaft 30. All of the above and any combination thereof are believed to be within the scope of the present invention, along with even further variation if such variation comes with the scope of any of the subjoined claims.

Each of the above constructions for valving, porting, sealing, and other functions may be combined in various ways and the invention is not intended to be limited to the constructions illustrated together in one drawing but may be used with various compatible features of any of the FIGS. 1 to 6 or the features of FIGS. 7 to 13 that follow.

Referring to FIGS. 7–13, a multi-cylinder embodiment of the present invention is illustrated, which is a four cylinder engine 250 in the described embodiment. A modified construction of the engine head 252 enclosing the inlet 254 and outlet 256 valves is also illustrated disposed on an engine block 251. The head 252 comprises five pieces, an aluminum base plate 258, a two-piece aluminum housing 260 for the inlet valve 254 and a separate two-piece aluminum housing 262 for the outlet valve 256. It is also within the scope of the present invention to have a one-piece head 252 or have the inlet 260 and outlet 262 housing be manufactured as one upper piece and one lower piece as described above in the single cylinder embodiment of the present invention, although it is believed that the five piece head provides more ease in repair than other configurations.

As illustrated in FIG. 9, the housings 260 and 262 are located on the base plate 258 by dowel pins 261, the base plate is located on the engine block 251 by dowel pins 263, and the housings 260, 262, base plate 258, and engine block 251 are secured together by a series of three rows of spaced bolts 264. Each of the valve housings 260 or 262 has an upper part **260*a*, 262*a* and lower part 260*b*, 262*b*, respectively, located upon one another by dowel pins 265**.

The valves 254 and 256 are preferably cooled by liquid cooling with galleys (not shown) in the base plate 258 and lower housing parts **260*b* and 262*b* associated with the liquid cooling system of the vehicle engine 250 in a manner known in the engine art to remove heat from below the valves 254 and 256**.

Within each respective valve housing 260 or 262 is a bore 266 or 268 within which the inlet valve 254 or the outlet valve 256, respectively, is disposed. An illustrative dimension of the inlet valve 254 would be approximately $2\frac{1}{2}$ inches in outside diameter, with an equivalently dimensioned bore 266 being machined in the inlet valve housing 260, which housing 260 illustratively may have a transverse dimension of approximately four inches square. The dimensions will, of course, vary with the application and are stated here merely for purposes of illustration. The inlet valve 254 has an interior bore 270 communicating with four inlet ports 274, 275, 276, and 277, one for each of the four cylinders 279, 280, 281, 282. The ports open at 90 degree intervals as viewed axially down the length of the valve 254, in order to match the firing order of the engine system which was modified. The intervals, however, may be modified to vary the firing order of the cylinders and the timing may be varied in many ways as will be described later or have been described with regard to the single cylinder embodiments above.

The inlet valve 254 also includes an optional baffle system 284 which breaks the interior bore 270 of the valve 254 into four elongated separate chambers 285, 286, 287, and 288, one chamber communicating with each of the four respective inlet ports 274, 275, 276, and 277. At the entrance to the baffle system 284 is disposed an impeller 289 either integrally formed from the ends of the chamber walls (as shown) or secured to the baffle system 284 to rotate with the baffle system 284 as if integrated. The impeller 289 comprises four blades **285*a*, 286*a*, 287*a*, and 288*a*, one for each respective chamber 285, 286, 287 and 288. The pitch of each blade 285*a*–288*a* is determined by twice the distance of the blade 285*a*–288*a* from the midpoint of the respective inlet port 274–277. The pitch of the blade 285*a*–288*a* is twice the above stated distance because the inlet valve 254 rotates at twice the speed of the crank shaft in the described embodiment. A different pitch would be required if a different rotational speed relationship is used between the crank shaft 17 and the inlet valve 254, with the proportional speed forming the multiplication factor to determine the respective pitches of the blades 285*a*–288*a***.

The impeller 289 and pitched blades **285*a*–288*a* will serve to balance the engine to provide equal amounts of fuel/air charge or air alone (as for diesel engine applications or other fuel injection system engine applications) to the respective cylinders 279–282. The higher pitched blade will provide the same amount of charge or air to proceed a longer distance to a port (277) in the same amount of time that a lower pitched blade will provide to a nearer port (274). The balance of the engine can thus be adjusted by adjusting the pitch of a blade 285*a*–289*a*. The blades 285*a*–289*a* may or may not be manufactured in a readily deformable material based on a trade-off of ready adjustability versus long term positional stability. The pitch will also be a right hand or left hand pitch based upon the direction of rotation of the valve 254**.

At each port, the respective baffle chamber has a deflector 290 (FIGS. 8, 9 and 12). The deflector 290 is welded to the adjacent walls of each respective elongated chamber and allows no flow to pass beyond the respective inlet port with which it is associated. The deflector 290 is also an optional construction of the present invention, since the engine would run effectively by the flow created by the pressure drop within the respective cylinder subsequent to the exhaust stroke of the cylinder. The deflector, however, eliminates charge from entering the dead space beyond the port and also directs the flow more efficiently in diminishing any eddy losses that may otherwise occur.

An illustrative dimension of the exhaust valve 256 would be an outside diameter of approximately 2½ inches, with an equivalently dimensioned bore 268 machined in the exhaust valve housing 262, which housing illustratively may have a transverse dimension of approximately four inches square. Again, the dimensions, of course, will vary with the application. The exhaust valve 256 has an interior bore 292 communicating with four exhaust ports 294, 295, 296, and 297, one for each of the four cylinders 279, 280, 281, and 282, opening at 90 degree intervals as viewed axially down the length of the valve 256, in order to match the firing order of the engine system that was modified.

The exhaust valve 256 has a sleeve 298 of an insulating material, such as asbestos, approximately ¼ inch thick inserted in the interior bore 292 of the valve 256 to insulate the valve-housing interface from the heat of combustion exhausted through the interior bore 292. A second sleeve 300 is inserted within the insulation sleeve 298. The second sleeve 300 is a thin stainless steel, or other compatible material insert having a typical material thickness of 0.032 inches to 0.036 inches in the described embodiment. Referring to FIG. 9, at each of the outlet ports 294, 295, 296, and 297, a portion of the insulation is cut away and a portion of the stainless steel sleeve insert is swaged in to the respective port. The interior surface of sleeve 300 forms a passageway 301 for manifolding the exhaust from the cylinders out of the engine.

The multi-cylinder embodiment 252 of the present invention is similar to the single cylinder embodiment in many external respects. A mounting block 302 may be secured to one end of the engine head 252, if desired, by bolts 304 threaded into bores 306 disposed in all of the housing portions 258, 260*a*, 260*b*, 262*a*, and 262*b* of the head 252, but the block 302 is optional based on the application. The block 302 has an inlet bore 308 (FIG. 8) and an outlet bore (not shown) similar to that illustrated in FIGS. 2 and 3. A carburetor 309 is attached to the block 302 at the inlet bore 308 and an exhaust system may be attached to the outlet bore of the block 302 by suitable attachment means, but may also be mounted to the housing portions 258, 260, and 262 directly in some applications. The exhaust system may simply be a muffler as shown in FIG. 2, may involve an exhaust pipe as used conventionally on automobile vehicles, or may just be a cone in a racing version of the engine. The present invention, however, eliminates the complex, heavy add-on inlet and exhaust manifolding systems utilized on present day automobiles between the carburetor and the engine inlet valves and between the engine exhaust valves and the exhaust pipe or exhaust system, along with eliminating all of the mechanical components necessary for conventional poppet valves.

The valves 254 and 256 communicate with the engine chambers 279, 280, 281, 282 via inlet and exhaust ports through lower housing portions 260*b* and 262*b* and base plate 258 as illustrated with respect to chamber 279 in FIG. 9. For simplicity, only one port on each of the inlet 254 and exhaust 256 valve will be described in detail, and is equally applicable to the other ports associated with the same valve. The inlet port 310 to the chamber 279 is formed by inlet ports 312 and 314 through lower housing portion 260*b* and the base plate 258, respectively. The exhaust port 316 from the chamber 279 likewise is formed by exhaust ports 318 and 320 through lower housing portion 262*b* and the base plate 258, respectively. As illustrated in FIGS. 8 and 9, the inlet and exhaust 316 ports may be angled in two directions in a manner as described above with respect to the ports illustrated in FIGS. 5 and 6 to diminish any eddy effects.

The inlet valving ports 274, 275, 276, and 277 or the cylinder head inlet ports 310 may have a slight radius cut away ahead of the leading edge 311 of the port as a lead port to obtain a slight pressure drop in the cylinder for a smoother running engine. Although more easily provided as a cut away portion at the leading edge 311 of the inlet valving ports 274–277, the lead port can be equally as well accomplished by recessing the cylinder head inlet ports 310 beyond the leading edge 312 thereof. The lead port permits some inlet air or charge to enter the working chamber early and commence flow at any earlier inlet stage to provide a smoother flow profile into the working chamber.

Lubrication of the valves 254 and 256 is provided between the ports by a conventional oil lubrication mechanism between rings 322 and 324 disposed on axially opposite sides of the each port. The rings 322 and 324 are operably associated with a labyrinth passageway providing oil to the areas 326 between the rings. The port areas 328 of the valves 254 and 256 are lubricated by pairs of lead graphite wipers 330 biased by springs 332 toward the respective valve 254 and 256. As illustrated only in FIG. 9, the wipers 330 may be assembled or replaced in the head 252 without disassembly of the head 252 via passageways 334 closed by plates 336 disposed at the end of each passageway 334 in flats 335 of the cylinder head 252, and secured to the cylinder head 252 by suitable bolt fasteners 337.

Again, lubrication may also be provided by alternate means, such as a graphite bearing insert for each rotor cemented into the cylinder head or held in by fasteners. The sealing rings 322 or 324 may even be self-lubricating, such as graphite rings or a similar material.

Figure 13:
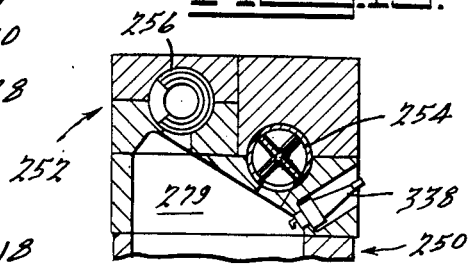
FIG. 13 is a vertical sectional view similar to FIG. 9 of an alternative embodiment of the construction illustrated in FIG. 9.

Each cylinder 279, 280, 281, 282 has a conventional spark plug 338, 339, 340, 341 operably associated with the cylinder in a manner as illustrated in FIG. 9 where the spark plug 338 is threadably disposed in bore 342 in base plate 258 and sets in recess 344 in base plate 258 and recess 346 in lower portion 260*b*. Each spark plug 338, 339, 340, 341 is also operably associated with the electrical system of the vehicle and a distribution system therefor. The present invention, however, permits placement of the spark plugs in a variety of positions, including on one side of either of the valves 254 or 256 (as shown) or between the valves 254 and 256 as illustrated in FIG. 5. Such variety permits placement of the spark plug as close to the distribution system as possible to use shorter wires than conventional engines, with an attendant cost savings for distributor wires. Alternatively, the position of the spark plugs may be designed to provide the most effective location for combustion of the charge, as desired. Further, the plane formed by the axes of the inlet 254 and exhaust 256 valves may form an angle with a horizontal plane passing through the engine 250, permitting the valves to be disposed closer together and allowing even further variety in placement of the spark plugs as illustrated in FIG. 13.

Figure 1:
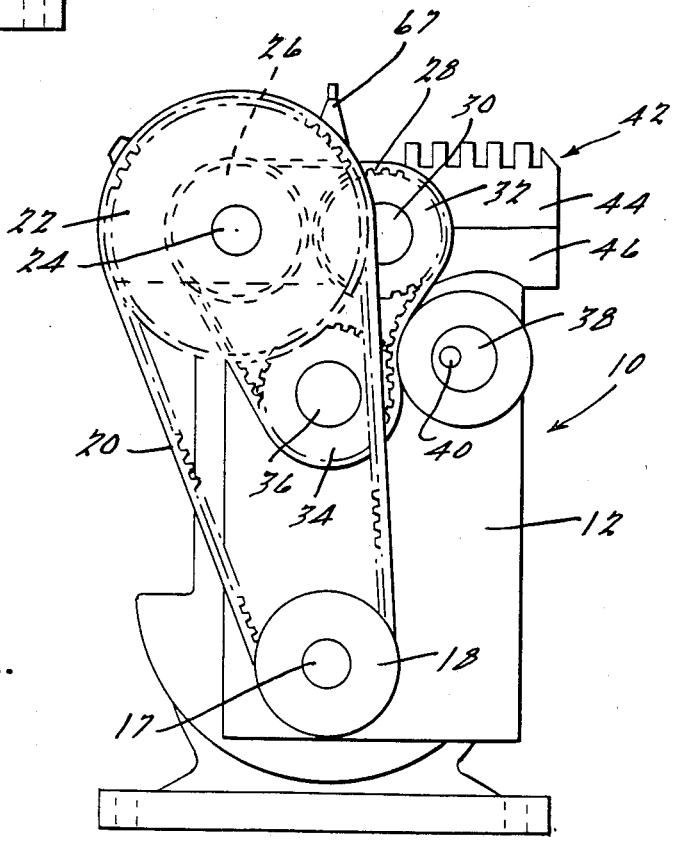
FIG. 1 is a front elevational view of an engine of the present invention.

The front 350 of the engine 250 and head 252 of the multi-cylinder embodiment is essentially illustrated by FIG. 1. Timing pulleys 26, 32 are mounted on the closed ends 31, 83 of the inlet 254 and exhaust 256 valves, respectively. The pulleys 26, 32 are drivingly connected by a timing belt 28. A drive pulley 22 is also mounted on the inlet valve end 83, and is drivenly connected via belt 20 to a pulley mounted on the engine crankshaft (FIGS. 1 and 2). A live bearing may also be mounted in a housing secured to the cylinder head adjacent the drive pulley 26, 32 of the valving means shafts 24, 30 within which the shafts 24, 30 would rotate and reduce any overloading of the shafts 24, 30 from the pulleys 26, 32 by absorbing the forces in the live bearing. Of course, all of the various combinations described above with regard to the various relationships, in the single cylinder embodiment, between the driven ends of the valves 254 and 256 and the ends of the valves 254 and 256 communicating with the carburetion (or inlet air) and the exhaust systems, respectively, are equally applicable to the multi-cylinder construction.

Similar to the single cylinder embodiment, the multi-cylinder embodiment may also be driven by belts due to the very minimal loading in driving the various wheels and pulleys. Such an arrangement also eliminates the need for any lubrication housing or other devices needed to lubricate a chain drive mechanism.

The timing of the engine is set once the head 252 is assembled on the engine. The circumferential width of the inlet ports 274, 275, 276 and 277 and exhaust ports 294, 295, 296 and 297 in relation to the width of the respective inlet 310 and exhaust 316 ports of the base plate 258 and lower housing portions **260*b* and 262*b* will determine port openings and closings. The firing order between inlet ports or between exhaust ports is determined by 90 degree peripheral opening separations as the valve 254 or 256 is viewed down its axis of rotation in the illustrated standard four cylinder embodiment, but would essentially be determined by a peripheral opening separation of 360 degrees divided by the number of cylinders. The timing between inlet and exhaust port openings for a single cylinder is determined by the distance between the leading and trailing edges of each valve port relative to one another and the fixed ports 310 and 316 and the angular phase relationship between those edges and the fixed ports. In one embodiment of the present invention, a suitable construction was found with the inlet and exhaust port openings each having a duration of approximately 140 degrees and an opening overlap of approximately 40 degrees at each cylinder for each cylinder. The duration, of course, may be any combination of degrees of port opening in the valve 254 or 256 plus degree of opening of the respective fixed port 310 or 316 based upon the amount of the periphery of the bore 266 or 268 is open by the respective port 310 or 316**.

Various fuels may be used with the engines illustrated in FIGS. 1 to 13. If a fuel injection system is used instead of a carburetion system, such as with diesel or gasoline fuels, the valving means will work equally well as an inlet air and diesel residual exhaust valving means. Other alternative fuels, such as hydrogen fuels, are also believed to be capable of use in the above described engines.

In a racing version of the proposed multi-cylinder embodiment, the ports of the inlet and exhaust valves are opened up so that the leading edge of the inlet valve and trailing edges of the exhaust valve, overlap both upon opening and closing of the inlet and exhaust valves, i.e., both inlet and exhaust each being open for more than 180 degrees of rotation of the valves. Such a configuration permits a vast amount of charge (which may have arrived via a turbocharger) to enter, combust, and exhaust through a cylinder at extremely rapid rates. The above racing configuration may be provided as a series of single cylinder heads mounted transversely along the length of an in-line engine, or as modules mounted transversely within a single cylinder head.

Thus, there is disclosed in the above description and in the drawings an improved rotary valve engine which fully and effectively accomplishes the objectives thereof. Any dimensions set forth in the above specification are merely representative and are not meant to be limiting on the scope of the invention. It will be apparent that variations and modifications of the disclosed embodiments may be made without departing from the principles of the invention or the scope of the appended claims.

What is claimed is:

1. A vehicle engine having at least one cylinder, having a piston moveably disposed therein, comprising cylinder head means disposed substantially at one end of said cylinder, wherein said cylinder, said piston, and said cylinder head means form a working chamber for said engine within each cylinder of said engine, said cylinder head means comprising a base element removeably secured to said engine and having an inlet port to and an outlet port from each said working chamber of said engine, an inlet valve housing, an exhaust valve housing, first means for fastening said base element to said engine, and second means for fastening said inlet valve housing and said exhaust valve housing to both said engine and said base element; and rotary valve means disposed within said cylinder head means comprising rotating means for valving an inlet charge to and exhaust from said working chamber, rotating about at least one axis, including means for porting said inlet charge to said inlet port and means for porting said exhaust from said outlet port, said porting means each having means for manifolding said inlet charge to said inlet port and said exhaust from said outlet port along the axis of rotation of said rotating valving means, wherein said inlet charge enters said inlet charge porting means substantially parallel to said axis of rotation of said inlet charge porting means via inlet manifold means external to said engine and said exhaust exits said exhaust porting means substantially parallel to said axis of rotation of said exhaust porting means via exhaust manifold means external to said engine.

2. A vehicle engine having at least one cylinder, having a piston moveably disposed therein, comprising cylinder head means disposed substantially at one end of said cylinder, wherein said cylinder, said piston, and said cylinder head means form a working chamber for said engine within each cylinder of said engine, said cylinder head means comprising a base element removeably secured to said engine and having an inlet port to and an outlet port from each said working chamber of said engine, an inlet valve housing, an exhaust valve housing comprising an upper portion, a lower portion, and removeable means for securing said upper and lower portions together, first means for fastening said base element to said engine, and second means for fastening said inlet valve housing and said exhaust valve housing to one of said engine or said base element; and rotary valve means disposed within said cylinder head means comprising rotating means for valving an inlet charge to and exhaust from said working chamber, rotating about at least one axis, including means for porting said inlet charge to said inlet port and means for porting said exhaust from said outlet port, said porting means each having means for manifolding said inlet charge to said inlet port and said exhaust from said outlet port along the axis of rotation of said rotating valving means, wherein said inlet charge enters said inlet charge porting means substantially parallel to said axis of rotation of said inlet charge porting means via inlet manifold means external to said engine and said exhaust exits said exhaust porting means substantially parallel to said axis of rotation of said exhaust porting means via exhaust manifold means external to said engine.

3. A vehicle engine having at least one cylinder, having a piston moveably disposed therein, comprising modular cylinder head means disposed substantially at one end of said cylinder, wherein said cylinder, said piston, and said cylinder head means form a working chamber for said engine within each cylinder of said engine, said cylinder head means including an inlet port to and an outlet port from each said working chamber of said engine, said modular cylinder head means comprising a base element, an upper and a lower inlet valve housing, an upper and a lower exhaust valve housing, and means for fastening said base element and valve housings together and to said engine; and rotary valve means disposed within said cylinder head means comprising rotating means for valving an inlet charge to and exhaust from said working chamber, rotating about at least one axis, including means for porting said inlet charge to said inlet port and means for porting said exhaust from said outlet port, said porting means each having means for manifolding said inlet charge to said inlet port and said exhaust from said outlet port along the axis of rotation of said rotating valving means.

4. An engine in accordance with claim 3, further comprising at least one oil galley extending substantially perpendicularly to the axis of rotation of at least one of said valving means.

5. An engine in accordance with claim 3, wherein said base element is integral with said engine.

6. A vehicle engine having at least one cylinder, having a piston moveably disposed therein, comprising cylinder head means disposed substantially at one end of said cylinder, wherein said cylinder, said piston, and said cylinder head means form a working chamber for said engine within each cylinder of said engine, said cylinder head means comprising a base element removeably secured to said engine and having an inlet port to and an outlet port from each said working chamber of said engine, an inlet valve housing comprising an upper portion, a lower portion, and removeable means for securing said upper and lower portions together, an exhaust valve housing, first means for fastening said base element to said engine, and second means for fastening said inlet valve housing and said exhaust valve housing to one of said engine or said base element; and rotary valve means disposed within said cylinder head means comprising rotating means for valving an inlet charge to and exhaust from said working chamber, rotating about at least one axis, including means for porting said inlet charge to said inlet port and means for porting said exhaust from said outlet port, said porting means each having means for manifolding said inlet charge to said inlet port and said exhaust from said outlet port along the axis of rotation of said rotating valving means, wherein said inlet charge enters said inlet charge porting means substantially parallel to said axis of rotation of said inlet charge porting means via inlet manifold means external to said engine and said exhaust exits said exhaust porting means substantially parallel to said axis of rotation of said exhaust porting means via exhaust manifold means external to said engine.

7. An engine in accordance with claim 6, wherein said lower inlet valve housing portion has an inlet port to each said working chamber of said engine corresponding to each said inlet port in said base element.

8. An engine in accordance with claim 6, wherein said exhaust valve housing comprises an upper portion, a lower portion, and removable means for securing said upper and lower portions together.

* * * * *